US005325788A

United States Patent [19]

Strickland et al.

[11] Patent Number: 5,325,788

[45] Date of Patent: Jul. 5, 1994

[54] SAFETY TROLLEY RESTRAINT SYSTEM FOR RAILROAD BRIDGES HAVING PIVOTAL CLAMPING ROLLERS

[75] Inventors: Michael R. Strickland, Richmond Hill; Kevin R. MacDonald, Toronto, both of Canada

[73] Assignee: Smmart Equipment Inc., Mississauga, Canada

[21] Appl. No.: 1,170

[22] Filed: Jan. 7, 1993

[51] Int. Cl.[5] ..... B61B 13/04

[52] U.S. Cl. ..... 104/119; 104/246; 104/247; 105/144; 105/157.1

[58] Field of Search ..... 104/89, 118, 119, 245, 104/246, 247; 105/141, 144, 157.1, 180, 148, 156; 182/3

[56] References Cited

U.S. PATENT DOCUMENTS

| | | | |
|---|---|---|---|
| 152,145 | 6/1874 | McGlashan | 104/246 X |
| 287,458 | 10/1883 | Olmsted | 104/246 X |
| 1,087,773 | 2/1914 | Johnson | 104/246 |
| 2,731,922 | 1/1956 | Robb | 105/156 |
| 2,761,396 | 9/1956 | Harlan | 105/148 X |
| 4,410,175 | 10/1983 | Shamp | 182/3 X |
| 4,767,091 | 8/1988 | Cuny | 182/3 X |
| 5,224,427 | 7/1993 | Riches et al. | 182/3 X |

*Primary Examiner*—Robert J. Oberleitner
*Assistant Examiner*—S. Joseph Morano
*Attorney, Agent, or Firm*—Leydig, Voit & Mayer, Ltd.

[57] ABSTRACT

A safety trolley restraint system for easy attachment to the rail of a railroad track crossing a bridge includes a trolley carriage with opposed rollers clampable to the rail so as to hold the trolley on the rail while permitting rolling movement of the trolley on the rail and provides a movable attachment point for the end of a safety line of a personnel safety harness. The carriage includes two halves pivoted together which may be opened to remove the trolley from the rail and closed and locked to secure the trolley to the rail. The trolley restraint attachment point is preferably swingable from side to side with respect to the rail and includes a swiveling mounted attachment eye for the personnel safety line.

4 Claims, 2 Drawing Sheets

SAFETY TROLLEY RESTRAINT SYSTEM FOR RAILROAD BRIDGES HAVING PIVOTAL CLAMPING ROLLERS

FIELD OF THE INVENTION

The present invention relates generally to railroad personnel safety devices and more particularly concerns a movable trolley restraint system for use with a safety line or fall arrest system for railroad personnel working on railroad bridges and the like.

BACKGROUND OF THE INVENTION

When railroad tracks cross rivers, ravines and the like, it is generally necessary to support the rails of the track on bridges or tressels. Frequently these bridges and tressels have been constructed with open sides outboard of the rails. In other words, they do not have sidewalls or guard rails along the edges of the bridge outside of the rails.

Rail bridges and track tressels, however, do require periodic inspection and maintenance of the roadbed including the track, ties, ballast and/or other supporting material. Accordingly, railroad personnel must cross the bridge or tressel, often on foot, to perform their necessary inspection and maintenance functions and work. The absence of sidewalls and/or guardrails along the edges of the bridges outboard the rails presents potentially unsafe and hazardous situations for railroad personnel who must walk along the tracks in connection with their inspection and maintenance duties.

OBJECTS AND SUMMARY OF THE INVENTION

It is the primary aim of the present invention to provide a trolley restraint system that may be quickly, conveniently and securely attached for rolling movement along the rails of railroad track extending over rail bridges, tressels and the like and to which a safety line or personnel fall arrest system and safety harness may be attached.

A more detailed object is to provide such a trolley restraint system that is relatively inexpensive to make and that can be directly attached to one of the railroad track rails.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
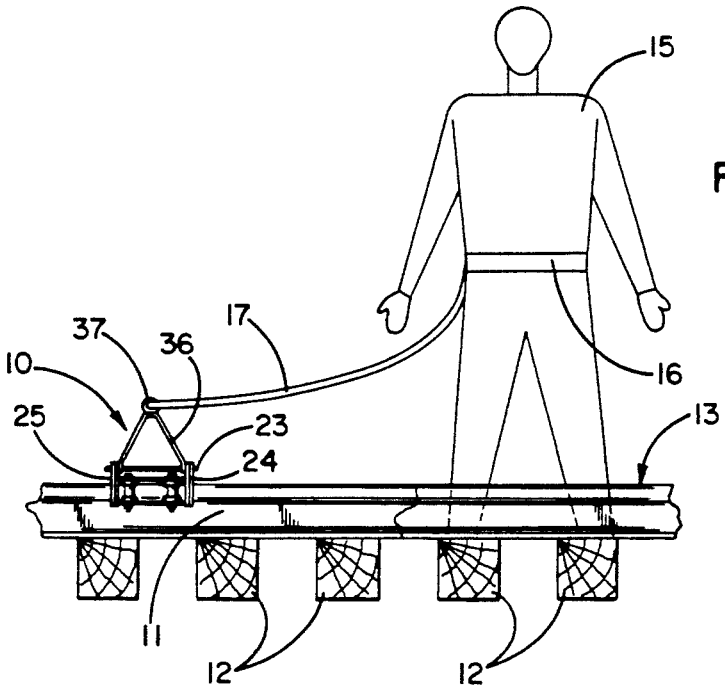
FIG. 1 is a fragmentary side elevation of a portion of railroad track illustrating the safety trolley restraint system of the present invention attached to one of the track rails and secured by a safety line to a railroad worker.
Figure 2:
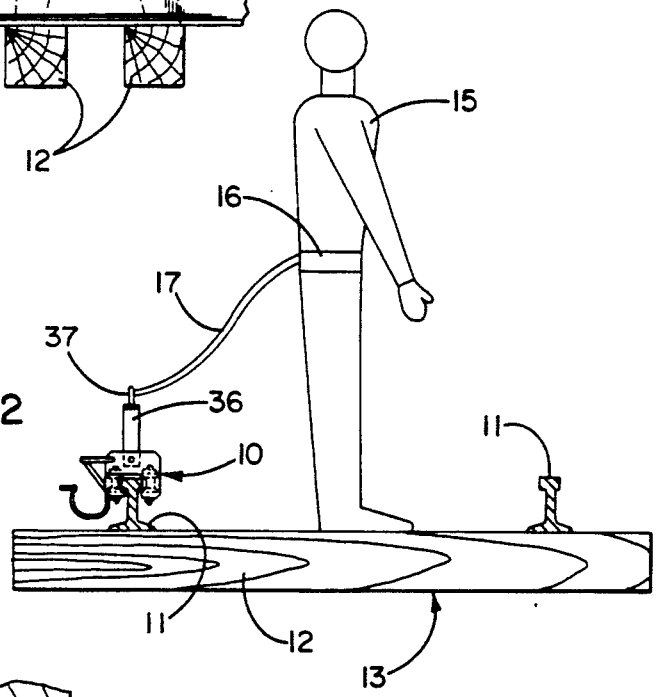
FIG. 2 is an end view, partially in section, of the track, safety trolley and the rail worker shown in FIG. 1.
Figure 3:
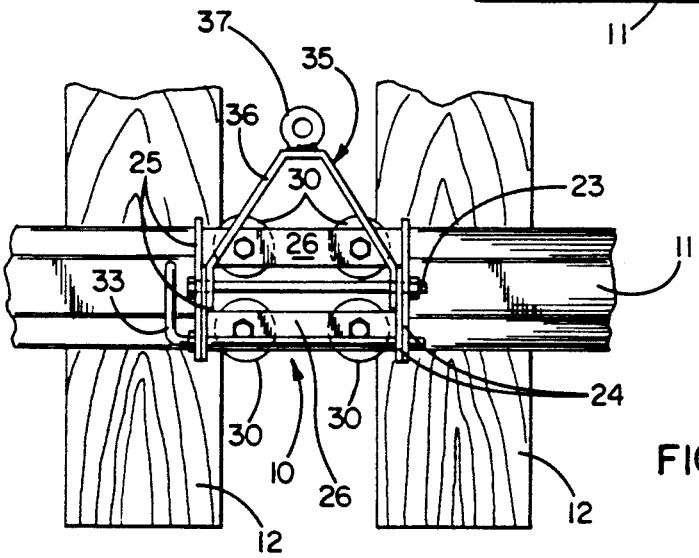
FIG. 3 is an enlarged, fragmentary plan view of the safety trolley of FIGS. 1 and 2.

Turning now to the drawings, there is shown in FIG. 1 a safety trolley restraint system 10 riding along a rail 11 supported by cross ties 12 of a railroad track, indicated generally at 13. Although not shown, it will be understood that the railroad track 13 may be supported by a rail bridge or track tressel and that the safety trolley restraint system 10 has particular utility in such circumstances. Indeed, as shown in FIG. 1, an individual 15, who may be a railroad inspector or track maintenance worker, is standing on the track roadbed between the rails 11. It will also be understood that the illustrated inspector or worker 15 wears a safety harness, only generally indicated at 16, with an attached safety line or fall arrest system 17 which may be secured to the safety trolley restraint system 10 of the present invention.

In accordance with the present invention, the safety trolley restraint system 10 includes a pair of generally inverted L-shaped carriage frames 21 and 22 hinged together by a pivot means such as a pin 23 or the like adjacent the ends of the generally horizontally extending legs of the frames 21 and 22. Each of the carriage frames 21 and 22 includes a pair of generally vertical end plates 24 and 25 and a pair of spaced apart, generally horizontal support plates 26 and 27 rigidly secured between the end plates.

Figure 4:
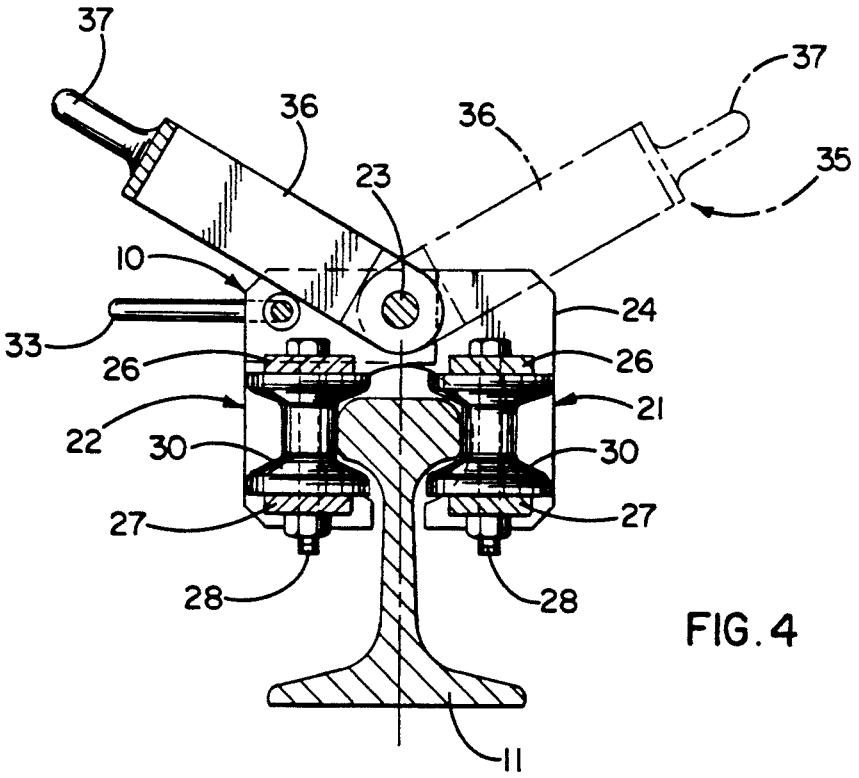
FIG. 4 is an end view of the safety trolley of FIG. 3 substantially as seen along line 4—4 with the trolley clamped on the rail and showing alternate positions of the restraint attachment handle.
Figure 5:
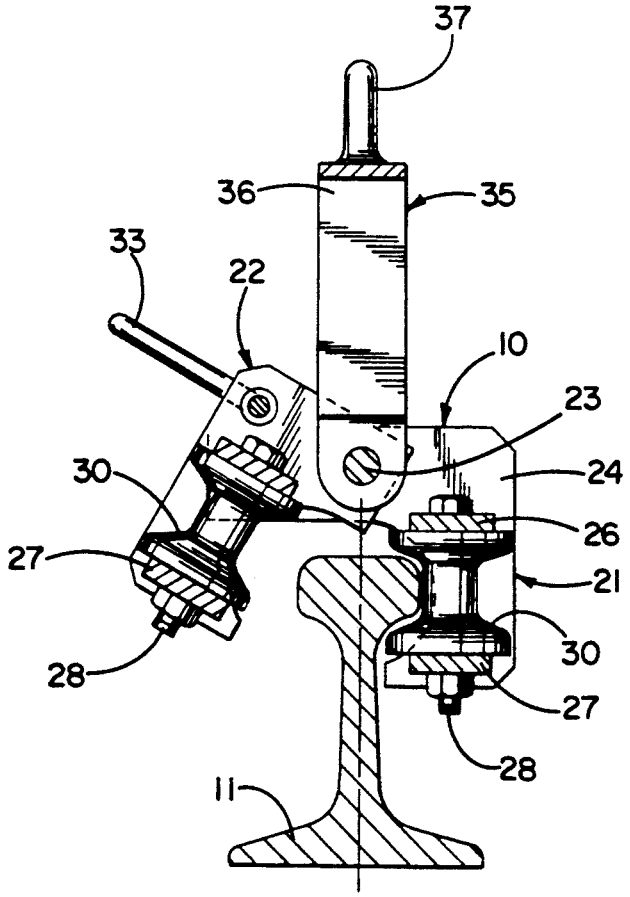
FIG. 5 is an end view, similar to FIG. 4 with the trolley unclamped from the rail and with the attachment handle in a vertical position.

As shown in FIGS. 4 and 5, the end plates 24 and 25 each have a profile formed to engage and retain opposite sides of the track top therebetween. Axles 28 (illustrated here as bolts) are inserted through appropriate openings in the support plates 26 and 27 for journalling a pair of rollers 30 on each of the hinged carriage frames 21 and 22. The rollers are preferably formed with upper and lower end flanges and a reduced diameter center section formed so as to engage and retain opposite sides of the rail top therebetween.

To secure the safety restraint trolley 10 on the rail 11, the two halves of the carriage 21 and 22 are pivoted to the open position as shown in FIG. 5. The trolley 10 is then placed on the rail 11 with the rollers 30 on the main carriage frame 21 in engagement with one side of the rail top. The other half of the carriage frame 22 is then pivoted down to the closed position, as shown in FIG. 4, with its rollers 30 in engagement with the other side of the rail top. A retaining pin 33 is then inserted through aligned openings formed in the end plates 24, 25 of the carriage halves 21 and 22 offset from the pivot pin 23. Thus, it will be understood that the rollers 30 capture the top or head of the rail 11 between them and attach the trolley 10 securely to the rail 11 while permitting the trolley to ride freely along the rail.

In order to attach the safety line 17 of the personnel harness 16 to the safety restraint trolley 10, a restraint attachment means 35 is provided on the trolley 10. In the preferred embodiment shown in the drawings, the restraint attachment means 35 comprises a generally bail-like handle 36 pivotally mounted on the end plates 24, 25 of the trolley by the pivot pin 23 so as to permit the handle to swing from side to side with respect to the rail 11. Also the attachment means 35 preferably is fitted with an attachment eye 37 mounted for swiveling movement on the handle 36 and to which the end of the personnel safety line 17 may be attached such as by a safety hook.

From the foregoing it will be appreciated that the safety trolley restraint system of the present invention includes a trolley that may be quickly and conveniently secured on a railroad track rail for rolling movement along the rail so as to provide a movable attachment point to which a personnel safely line may be attached to arrest falls from rail bridges and the like.

We claim as our invention:

1. A safety trolley resistant system attachable to a railroad track rail for rolling movement along the top thereof so as to movably anchor the end of a personnel safety line secured to a safety belt, comprising, in combination, a carriage including a pair of frame halves pivotally hinged together about a generally horizontally extending pivot pin, each of said frame halves including a pair of spaced-apart, generally vertical end plates and a pair of generally horizontally extending, vertically spaced-apart support plates, said end plates each having a profile formed to engage and retain opposite sides of said railroad track rail top therebetween, a plurality of rollers journalled on axles secured between said spaced-apart support plates in each of said frame halves, each of said rollers having upper and lower end flanges with a reduced diameter center section formed so as to engage and retain opposite sides of said railroad track rail top therebetween, selectively engageable retaining means for securing said hinged frame halves in closed position with said rollers clamped so that said upper and lower end flanges substantially envelop said rail top, said retaining means also being disengageable for releasing at least one of said hinged frame halves to pivot open and unclamp all of said plurality of rollers on said one hinged frame half from said rail top, and restraint attachment means carried by said carriage for securing said end of said personnel safety line thereto.

2. A safety trolley as defined in claim 1 wherein said retaining means includes a generally horizontally extending lock pin disposed in offset relation to said pivot pin for securing said frame halves in closed position.

3. A safety trolley as defined in claim 1 wherein said restraint attachment means includes a handle portion mounted on said trolley carriage for pivotal movement from side to side with respect to said rail.

4. A safety trolley as defined in claim 1 wherein said restraint attachment means includes an attachment eye mounted for swiveling movement with respect to said trolley carriage.

* * * * *